US010422133B2

(12) United States Patent
VanHoose et al.

(10) Patent No.: US 10,422,133 B2
(45) Date of Patent: Sep. 24, 2019

(54) PRECAST CONCRETE COMPOSITE WALL

(71) Applicant: Innovative Design Solutions LLC, Loudon, TN (US)

(72) Inventors: Jeff VanHoose, Lenoir City, TN (US); Don Atkins, Louisville, TN (US)

(73) Assignee: Innovative Design Solutions LLC, London, TN (US)

( * ) Notice: Subject to any disclaimer, the term of this patent is extended or adjusted under 35 U.S.C. 154(b) by 0 days.

(21) Appl. No.: 15/443,389

(22) Filed: Feb. 27, 2017

(65) Prior Publication Data

US 2017/0298627 A1 Oct. 19, 2017

Related U.S. Application Data

(63) Continuation-in-part of application No. 14/610,475, filed on Jan. 30, 2015.
(Continued)

(51) Int. Cl.

| | |
|---|---|
| ***E04C 2/288*** | (2006.01) |
| ***E04B 1/41*** | (2006.01) |
| ***B28B 1/14*** | (2006.01) |
| ***E04B 2/72*** | (2006.01) |
| ***E04B 2/00*** | (2006.01) |
| ***B28B 19/00*** | (2006.01) |
| ***B28B 23/02*** | (2006.01) |

(52) U.S. Cl.
CPC ..... *E04C 2/288* (2013.01); *B28B 1/14* (2013.01); *B28B 19/003* (2013.01); *B28B 19/0015* (2013.01); *B28B 23/02* (2013.01); *E04B 1/41* (2013.01); *E04B 2/721* (2013.01); *E04C 2/46* (2013.01); *E04B 2103/02* (2013.01)

(58) Field of Classification Search
CPC ..... E04C 2/288; E04C 2/46; B28B 19/0015; B28B 23/02; B28B 19/003; B28B 1/14; E04B 1/41; E04B 2/721; E04B 2103/02; H05K 999/99
USPC ..... 52/309.12, 309.17, 404.1, 406.1, 407.4, 52/404.2, 414, 506.05, 506.06, 506.08, 52/513
See application file for complete search history.

(56) References Cited

U.S. PATENT DOCUMENTS 1,718,402 A * 6/1929 Bitney ..... E04B 1/4178 52/379
1,929,835 A * 10/1933 Awbrey ..... E04B 1/4107 52/379

(Continued)

FOREIGN PATENT DOCUMENTS

EP 127359 A1 * 5/1984 ..... E04B 1/41
WO WO2010/113105 10/2010

*Primary Examiner* — Brent W Herring
(74) *Attorney, Agent, or Firm* — Pitts & Lake, P.C.

(57) ABSTRACT

A precast concrete wall structure and method for forming a wall structure are disclosed. A forming member is positioned within a casting bed. The forming member comprises a layer of insulating material defining a plurality of integrally-formed rectangular protrusions extending in a parallel and spaced-apart relationship to one another to define a plurality of rectangular-shaped channels therebetween. The forming member also defines at least one cutout for defining a first portion of a fastener for securing the wall structure to a support structure. A second portion of the fastening member is positioned within the cutout. Uncured concrete is placed within the casting bed and allowed to cure.

8 Claims, 11 Drawing Sheets

Related U.S. Application Data

(60) Provisional application No. 62/300,299, filed on Feb. 26, 2016.

(56) References Cited

U.S. PATENT DOCUMENTS 2,780,936 A * 2/1957 Hillberg ..... E04B 1/4107 52/379
4,512,126 A * 4/1985 Walston ..... E04B 1/14 52/251
4,782,635 A * 11/1988 Hegle ..... E04B 2/94 52/126.4
4,841,702 A * 6/1989 Huettemann ..... E04B 5/04 52/309.12
4,942,707 A * 7/1990 Huettemann ..... E04B 5/04 264/32
5,526,623 A * 6/1996 Bullivant ..... E02D 27/01 405/229
5,548,939 A * 8/1996 Carmical ..... E04B 1/4135 52/698
6,058,672 A * 5/2000 McClellan ..... E04B 1/04 52/309.12
6,427,406 B1 8/2002 Weaver et al.
6,688,073 B2 * 2/2004 Vanderwerf ..... B28B 19/0061 249/112
7,237,368 B2 * 7/2007 Richardson ..... E04B 1/4107 52/295
7,654,057 B2 * 2/2010 Zambelli ..... E04B 1/4107 411/82
7,739,844 B2 * 6/2010 Gharibeh ..... B28B 19/003 52/309.8
7,810,293 B2 * 10/2010 Gibbar ..... E04C 2/288 52/309.7
7,814,710 B2 * 10/2010 Foglia ..... E04B 1/4107 52/709
7,836,660 B2 * 11/2010 Gharibeh ..... B28B 19/003 52/364
8,327,596 B2 * 12/2012 Bratton ..... E04B 1/28 52/481.1
8,365,484 B2 * 2/2013 Foley ..... E04B 1/4114 403/403
8,491,831 B2 7/2013 Buedel et al.
8,561,366 B2 * 10/2013 Gasperi ..... E04B 2/94 52/235
8,635,832 B2 * 1/2014 Heudorfer ..... E04B 1/4107 52/704
8,844,227 B1 * 9/2014 Ciuperca ..... E04C 2/296 52/309.11
8,966,833 B2 * 3/2015 Ally ..... E04B 1/41 52/122.1
9,238,155 B2 * 1/2016 Borchardt ..... A62B 35/0068
9,803,354 B1 * 10/2017 Francies, III ..... E04B 1/41
2003/0115822 A1 * 6/2003 Lejeune ..... B28B 23/0056 52/677
2005/0086904 A1 * 4/2005 Foley ..... B28B 19/003 52/782.1
2007/0039281 A1 * 2/2007 Zambelli ..... E04B 1/4107 52/710
2007/0144093 A1 * 6/2007 Messenger ..... E02D 27/02 52/309.12
2008/0041004 A1 * 2/2008 Gibbar ..... E04C 2/288 52/309.12
2010/0101175 A1 * 4/2010 Hohmann ..... E04B 1/4107 52/698
2011/0138735 A1 * 6/2011 Foley ..... E04B 1/4114 52/699

* cited by examiner

PRECAST CONCRETE COMPOSITE WALL

CROSS-REFERENCE TO RELATED APPLICATIONS

This application is a continuation-in-part of U.S. patent application Ser. No. 14/610,475, filed on Jan. 30, 2015, and further claims the benefit of U.S. Provisional Patent Application No. 62/300,299, filed on Feb. 26, 2016, each of which is incorporated in its entirety herein by reference.

STATEMENT REGARDING FEDERALLY-SPONSORED RESEARCH OR DEVELOPMENT

Not Applicable

BACKGROUND OF THE INVENTION

1. Field of Invention

The present general inventive concept relates to prefabricated wall structures, and more particularly, to a precast concrete composite wall structure useful, for example, as a knee wall structure, cladding wall structure, etc., and method for manufacturing a precast concrete composite wall structure.

2. Description of the Related Art

Precast concrete wall structures are often used as a way of avoiding more costly, time consuming, and/or labor intensive processes of fabricating walls from brick or block materials, wood, metal studs, or the like, or fabricating walls by pouring and curing concrete in situ. Generally, the manufacture of a precast concrete wall structure involves the use of a casting bed fabricated to form a mold for pouring and curing concrete in the shape of a desired wall structure. The casting bed is typically oriented with the desired wall structure shape extending in a horizontal plane. Desired non-concrete structural fixtures may be added to the casting bed, and concrete may then be poured into the casting bed, thereby filling the mold shape and at least partially surrounding the fixtures. The concrete may then be allowed to cure, thereby forming a concrete wall structure in the desired shape. Once cured, the wall structure may be removed from the casting bed, such as for example by disassembling the casting bed from around the wall structure. The wall structure may then be transported to a desired location, where it can be stood upright along a substantially vertical plane (or other desired orientation) for use as a structural member in a building construction.

One prior art method for manufacturing a precast concrete wall structure is described in U.S. Pat. No. 8,491,831, issued to Buedel et al. (hereinafter "the '831 patent"). In the method of the '831 patent, a frame is provided having a plurality of spaced-apart wall studs interconnecting opposing first and second wall plate members. The frame is placed within a casting bed extending along a horizontal plane, and a layer of insulating material is positioned overlaying the frame. A plurality of insulating foam blocks are then placed above the insulating layer at spaced apart intervals to define void channels extending therebetween along the length of the casting bed. Lengths of rebar are positioned within the channels, and concrete is poured into the casting bed, thereby filling the channels and surrounding the rebar, covering the insulating foam blocks, and filling the spaces between the first and second wall plate members and the adjacent sides of the casting bed. The concrete is allowed to cure, thereby forming a concrete wall structure having a substantially planar concrete first outer surface, a plurality of steel-reinforced concrete "ribs" extending internally of the structure, and a second outer surface defined by the frame structure and adjacent surface of the insulating layer. Concrete top beam and toe sections are provided extending above and below the frame structure at locations corresponding to the spaces between the first and second wall plate members and the adjacent sides of the casting bed. Thereafter, the concrete wall structure may be removed from the casting bed, such as by removing one or more sides of the casting bed and/or lifting the wall structure therefrom.

In methods and apparatus for forming precast wall structures of the type described above, significant problems may be encountered with regard to quality control of the finished precast wall structure. Specifically, while pouring the unfinished concrete into the casting bed described above, difficulty may be encountered in maintaining the desired spaced-apart configuration of the insulating foam blocks. As the unfinished concrete flows over and around the insulating foam blocks, such blocks may be prone to flex and/or shift laterally along the layer of insulating material, and may further be prone to shift vertically due to buoyancy of the blocks in the more dense unfinished concrete. Furthermore, depending upon the flexural strength and stiffness of the layer of insulating material, the layer of insulating material may be subject to flexural deformation and/or failure under the weight of the unfinished concrete. The end result may be a finished wall structure which does not strictly conform to desired specifications.

Additional limitations associated with prior art methods and apparatus for forming precast wall structures of the type described above are encountered with regard to the relative difficulty in positioning the wall structures in a finished building structure. For example, prior art precast wall structures of the type described above typically do not include fasteners or other apparatus for securing the wall structures to one another or to a suitable support structure of a building, such as for example a building frame. Accordingly, in order for the prior art precast wall structures to be secured in a permanent building structure, additional concrete, mortar, adhesive, or the like (hereinafter, collectively, "adhesives") must be used to secure the precast wall structures to one another and/or to the building support structure. Additionally, or in the alternative, fasteners may be used to secure the prior art precast wall structures to the building support structure. For example, in various applications, holes may be bored in the prior art precast wall structure to allow for receipt therein of bolts or other suitable fasteners, thereby allowing the prior art structure to be secured to a portion of a building frame, such as a column, girt, structural beam, or the like. Such holes may, in various instances upon formation, result in damage and/or degradation of the structural integrity of the precast wall structure. Additionally, the use of the above-discussed adhesives and/or fasteners in on-site installation of precast concrete wall structures is, in many cases, laborious, time consuming, and expensive.

In various applications of precast concrete wall structures, such as for example the use of precast concrete wall structures in forming a knee wall, sleeper wall, cladding wall, or other such wall structure in a building (hereinafter, collectively, "wall structure"), it is desirable to provide a precast concrete wall structure which can be installed relatively quickly and conveniently in an existing building support structure, without necessitating the use of adhesives or fasteners which require destructive boring or other modification to the precast concrete wall structure. Accordingly, an improved method for manufacturing a precast concrete wall structure, and a precast concrete wall structure allowing for relatively quick and easy installation, is desired.

BRIEF SUMMARY OF THE INVENTIVE CONCEPT

The present general inventive concept, in various example embodiments, provides a precast concrete wall structure and a method for forming a wall structure. Various example embodiments of the present general inventive concept may be achieved, for example, by providing an insulating layer comprising a layer of insulating material having a substantially flat first surface and an opposite second surface defining a plurality of integrally-formed rectangular protrusions extending along a length dimension of the insulating layer in a parallel and spaced-apart relationship to one another to define a plurality of rectangular-shaped channels therebetween. A concrete face may be provided in mating relationship with the second surface of the insulating layer. The concrete face may comprise a layer of concrete material having a first surface disposed adjacent the second surface of the insulating layer. The first surface of the layer of concrete material may define a plurality of rectangular-shaped ribs, and each rib may be keyed to and disposed within a respective channel of the layer of insulating material. At least one first fastener may be disposed along a plane coplanar with the insulating layer first surface, the first fastener being configured to secure the wall structure adjacent to a support structure.

In additional example embodiments, the at least one first fastener may comprise a first member defining a slot and a second member defining a tabbed portion configured to be received within the slot and engaged by the first member to limit withdrawal of the tab from the slot. In some embodiments, the first member may comprise a hollow channel embedded within the wall structure. The channel may define the slot along a length thereof, and the slot may open to a surface of the wall structure coplanar with the insulating layer first surface. The channel member may, in some embodiments, further define a pair of lips extending along opposite sides of the slot and overhanging an interior of the channel member. In some embodiments, the first member may further comprise at least one anchor member secured to a surface of the channel member opposite the slot. In some such embodiments, at least the anchor member of the first member may be embedded in the concrete face. In some embodiments, for each first fastener, the concrete face may further define a first concrete block integrally formed with the layer of concrete material. The first concrete block may have a first surface extending coplanar with the insulating layer first surface, and the first member may be embedded in the first concrete block.

In some embodiments, the second member may define an elongated first portion having a first end defining the tabbed portion and an elongated second portion extending at a substantially right angle to the first portion. In certain embodiments, the first portion first end may define a flat portion having a pair of tabs extending outwardly from a longitudinal centerline of the first portion and a tapered portion inward of the tabs. In certain such embodiments, in a first orientation of the second member in relation to the first member, in which the tabs extend parallel to the slot, the tabs may be received through the slot within the channel with the tapered portion positioned between the lips of the first member; and in a second orientation of the second member in relation to the first member, in which the tabs extend along a plane perpendicular to the slot, the tabs may be engaged by the lips, thereby limiting withdrawal of the tab from the slot. In some embodiments, the second portion of the first fastener second member may be defined by a length of structural steel. In some embodiments, the structural steel may be angle iron.

Various additional embodiments of the present general inventive concept may be achieved by providing at least one second fastener disposed along a plane coplanar with the insulating layer first surface. In various embodiments, the second fastener may be configured to secure the wall structure adjacent a floor structure. In some embodiments, for each second fastener, the concrete face may further define a second concrete block integrally formed with the layer of concrete material. The second concrete block may have a first surface extending coplanar with the insulating layer first surface, and in some embodiments, the second fastener may be secured to the second concrete block. In some embodiments, the second fastener may define an L-bracket having a first flange extending along the second concrete block first surface and a second flange extending outwardly from the second concrete block first surface at an approximate right angle thereto. In some embodiments, the first flange of the L-bracket may be embedded in the second concrete block.

The present general inventive concept, in various additional embodiments, provides a fastener useful in securing a concrete structure to a support structure. Various embodiments of the present general inventive concept may be achieved, for example, by providing an anchor comprising a hollow channel defining a slot along a length thereof and a pair of lips extending along opposite sides of the slot and overhanging an interior of the channel. The channel may be configured to be embedded within the concrete structure with the slot opening to an external surface of the concrete structure. An elongated tab fastener may be provided having a first end defining a flat portion with a pair of tabs extending outwardly from a longitudinal centerline of the tab fastener and a tapered portion inward of the tabs. In such embodiments, in a first orientation of the tab fastener in relation to the anchor, in which the tabs extend parallel to the slot, the tabs may be received through the slot within the channel with the tapered portion positioned between the lips; and in a second orientation of the tab fastener in relation to the anchor, in which the tabs extend along a plane perpendicular to the slot, the tabs may be engaged by the lips, thereby limiting withdrawal of the tab fastener from the anchor.

Various additional embodiments of the present general inventive concept may be achieved by providing a tab fastener having a second end secured to an elongated member. In such embodiments, the elongated member may extend at a substantially right angle to the longitudinal centerline of the tab fastener.

The present general inventive concept, in various additional embodiments, provides a method for forming a wall structure. Various embodiments of the present general inventive concept may be achieved, for example, in which a forming member is positioned within a casting bed, the casting bed having a plurality of upright surfaces defining a generally rectangular interior area, the forming member comprising a layer of insulating material defining a plurality of integrally-formed rectangular protrusions extending along a length dimension of the forming member in a parallel and spaced-apart relationship to one another to define a plurality of rectangular-shaped channels therebetween, the forming member further comprising at least one cutout for defining a first block. A portion of a fastener is positioned for securing the wall structure to a support structure within the at least one cutout. Uncured concrete is placed within the casting bed and allowing the concrete to cover the forming member and substantially fill the channels, and the concrete is allowed to cure.

Various additional embodiments may be achieved in which the portion of the fastener comprises an elongated hollow channel defining a slot along a length thereof and a pair of lips extending along opposite sides of the slot and overhanging an interior of the channel. In such embodiments, the operation of positioning the portion of the fastener may include positioning the slot against a lower surface of the casting bed. Other embodiments may be achieved in which a plurality of anchor segments are fixed to the channel opposite the slot. Other embodiments may be achieved in which an elongated tab fastener is formed having a first end defining a flat portion with a pair of tabs extending outwardly from a longitudinal centerline of the tab fastener and a tapered portion inward of the tabs and a second end secured to an elongated member, the elongated member extending at a substantially right angle to the longitudinal centerline of the tab fastener. In various additional embodiments, upon allowing the concrete to cure, the wall structure is placed against a support structure with the slot adjacent the support structure. In such embodiments, with the tabs of the tab fastener extending parallel to the slot, the tabs are inserted through the slot within the channel with the tapered portion positioned between the lips, and the tab fastener is rotated in relation to the anchor, such that the tabs extend along a plane perpendicular to the slot and the elongated member extends in overlying relationship to the support structure. In such embodiments, the tabs are engaged by the lips, thereby limiting withdrawal of the tab fastener from the anchor.

BRIEF DESCRIPTION OF THE SEVERAL VIEWS OF THE DRAWINGS

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DESCRIPTION OF THE INVENTION

Reference will now be made to certain example embodiments of the present general inventive concept which are illustrated in the accompanying drawings and illustrations. The example embodiments are described herein in order to explain the present general inventive concept by referring to the figures. The following detailed description is provided to assist the reader in gaining a comprehensive understanding of the structures and fabrication techniques described herein. Accordingly, various changes, modifications, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Figure 2:
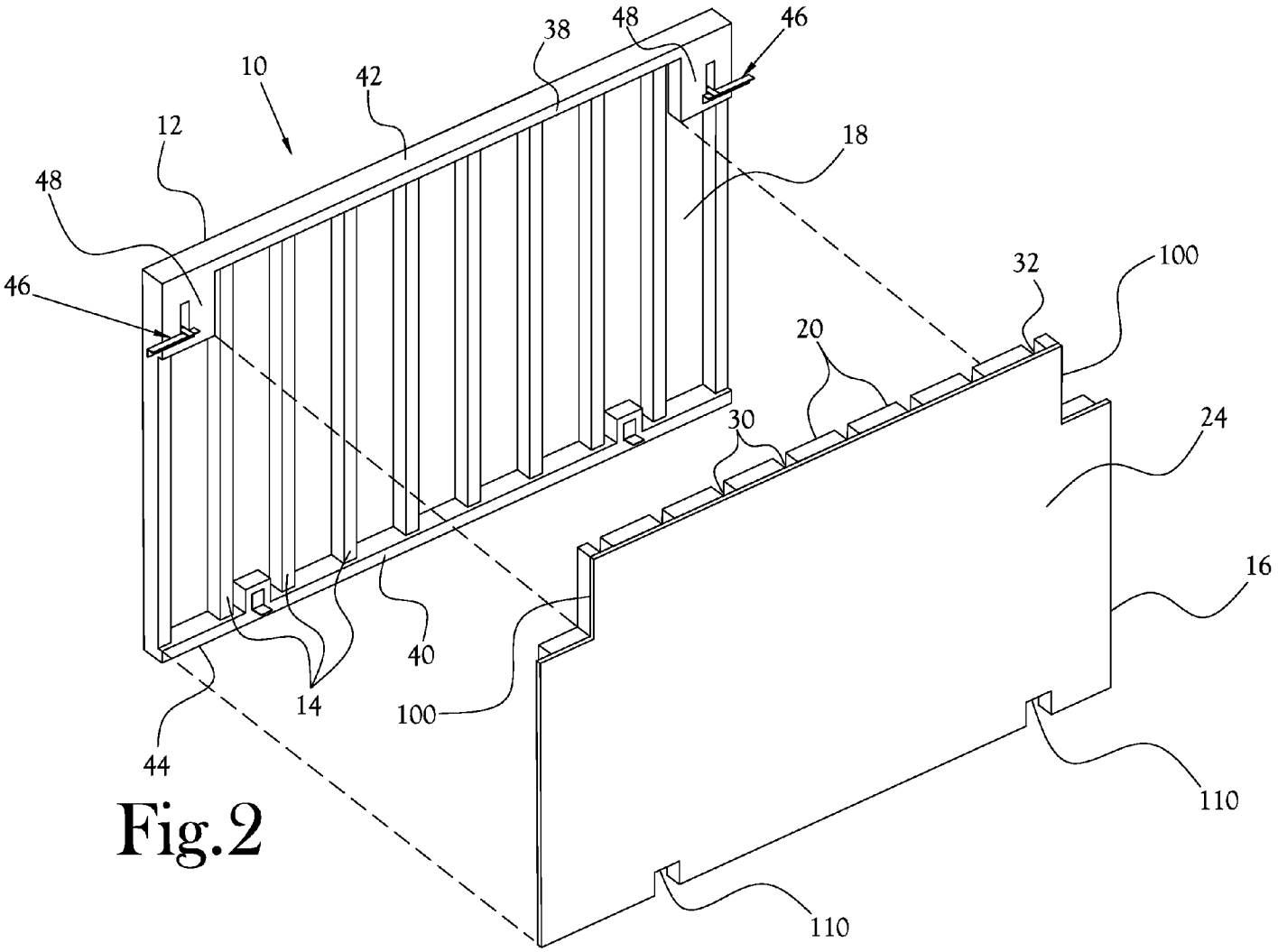
FIG. 2 is an exploded view of the precast concrete composite wall of FIG. 1.
Figure 3:
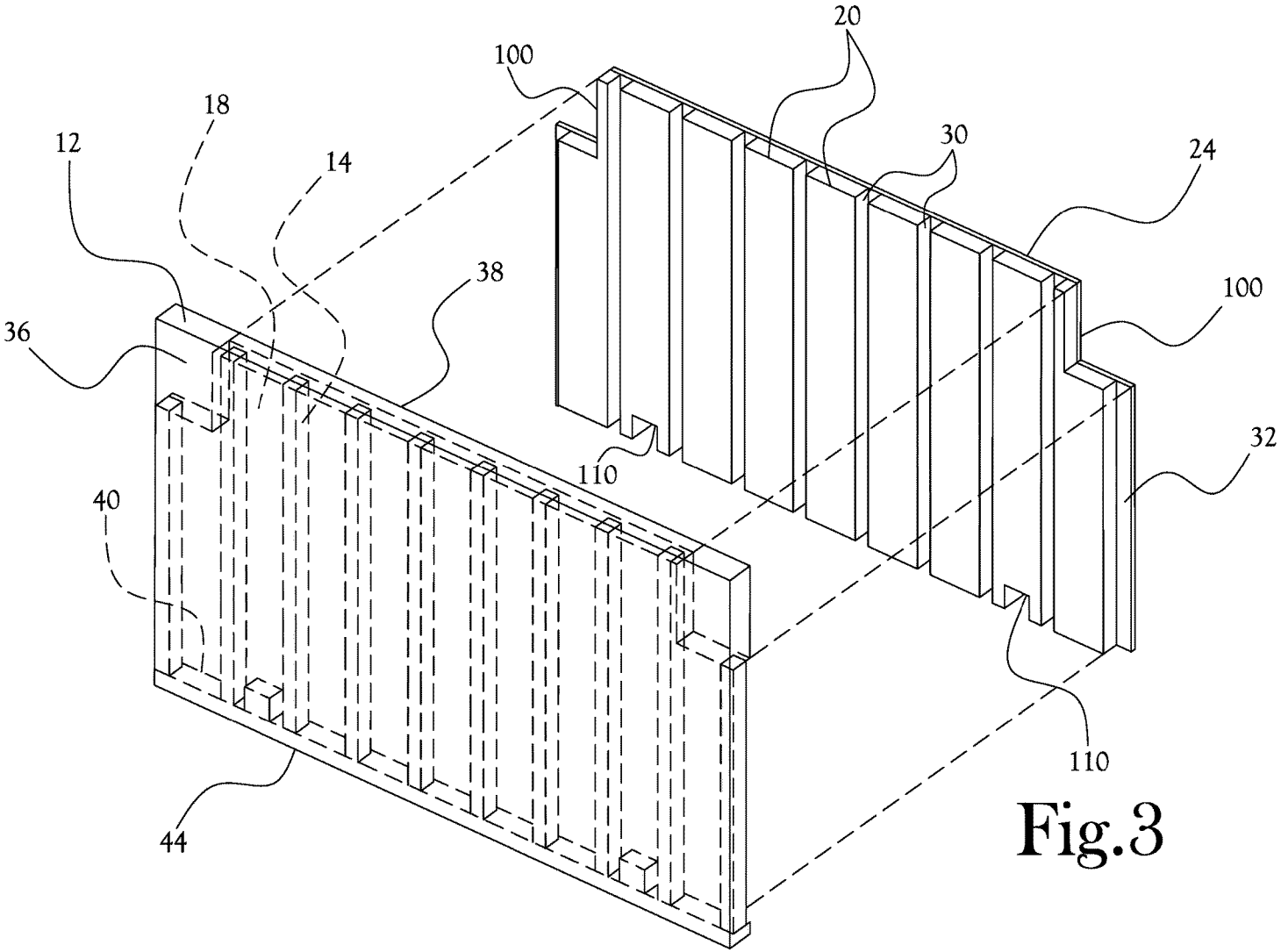
FIG. 3 is another exploded view of the precast concrete composite wall of FIG. 1.

In accordance with several features of the present general inventive concept, various embodiments of a precast concrete wall structure and method for manufacturing a precast concrete wall structure are disclosed herein and in the accompanying figures. With reference to the accompanying figures, and with particular reference to FIGS. 1-3, in one embodiment, a wall structure 10 is provided which includes an outer concrete face 12 defining an outwardly-facing surface 36 forming an exterior surface of the wall structure 10, and an inwardly-facing surface 18 defining a plurality of inwardly-facing ribs 14. In the illustrated embodiment, each of the ribs 14 is of a substantially rectangular cross-section and extends substantially vertically along the inwardly-facing surface 18 of the concrete face 12 in substantially parallel-planar, spaced apart relation to the other ribs. In the illustrated embodiment, the concrete face 12 further defines an elongated upper beam portion 38 and an elongated lower toe portion 40. The upper beam portion 38 extends substantially horizontally along the upper edge 42 of the concrete face 12 and inwardly from the inner surface 18 in an orientation substantially perpendicular to the ribs 14 to define an upper-most side of the wall structure 10. Similarly, the lower toe portion 40 extends substantially horizontally along the lower edge 44 of the concrete portion 12 and inwardly from the inwardly-facing surface 18 in an orientation substantially perpendicular to the ribs 14 to define a lower-most side of the wall structure 10.

The wall structure 10 further includes a forming member 16 extending along the inwardly-facing surface 18 of the concrete face 12. The forming member 16 defines a substantially planar inwardly-facing surface 24 and a plurality of rectangular protrusions 20 extending outwardly from an outwardly-facing surface 32 thereof. The rectangular protrusions 20 are sized and shaped to be received in mating engagement between each of the ribs 14. In several embodiments, the forming member 16 is constructed from a material that allows the forming member 16 to provide moisture resistance and vapor permeability to the wall structure 10 and/or to decrease the overall thermal conductivity of the wall structure 10. For example, in several embodiments, the forming member 16 is fabricated from an insulating material, such as for example expanded polystyrene (EPS), extruded polystyrene (XPS), rockwool, or other such material. In a preferred embodiment, the forming member 16 is both resistant to moisture and thermally insulating.

In one embodiment, the forming member 16 comprises a layer of EPS material having a plurality of integrally-formed protrusions 20 extending along an outwardly-facing surface 32 thereof. The protrusions 20 are generally rectangular in shape and extend in a parallel and spaced-apart relationship to one another to define a plurality of rectangular-shaped channels 30 therebetween. As will be discussed in greater detail below, in various embodiments of a method of manufacture according to several features of the present general inventive concept, the channels 30 provide mold forms for forming the ribs 14 of the concrete face 12 during manufacture of the wall structure 10. Hence, each rib 14 of the concrete face 12 is mated to, and is received within, a respective channel 30 of the forming member 16, and each protrusion 20 is received between and adjacent corresponding ribs 14 of the concrete face 12.

It will be understood that the specific dimensions of the various elements of the forming member 16 may vary depending upon the desired characteristics of the finished wall structure 10. For example, in one embodiment, the rectangular protrusions 20 may be approximately 20.5 inches wide, while the channels 30 may be approximately 3.5 inches wide and approximately 5.5 inches deep. Accordingly, each mating rib 14 may be approximately 3.5 inches wide and approximately 5.5 inches deep, and each rib 14 may be spaced approximately twenty-four inches apart, centerline-to-centerline. In this embodiment, the portions of the forming member 16 extending between the rectangular protrusions 20 may be approximately 1.5 inches thick. However, it will be understood that the present general inventive concept is not limited to such dimensional restrictions.

Figure 1:
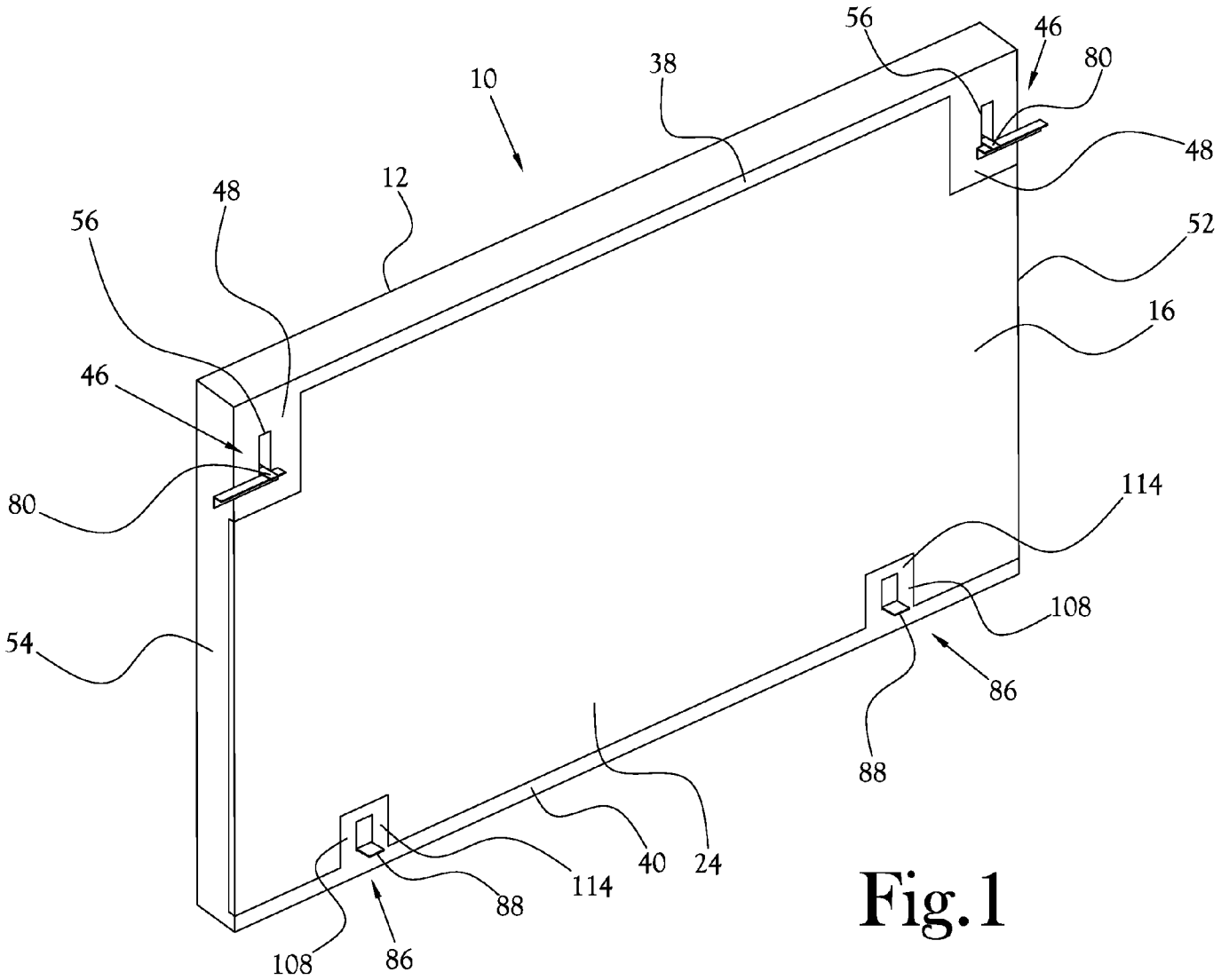
FIG. 1 is a perspective view showing one embodiment of a precast concrete composite wall constructed in accordance with several features of the present general inventive concept.

Referring to FIG. 1, in several embodiments, the planar inwardly-facing surface 24 of the forming member 16 terminates at a lower edge of the top beam 38 and at an upper edge of the toe 40. In certain of these embodiments, the top beam 38 and toe 40 each extend toward an inner surface of the wall structure 10 to at least partially surround upper and lower ends, respectively, of the forming member 16. In some embodiments, the top beam 38 and toe 40 portions of the concrete face 12 may each extend inwardly to completely surround the upper and lower ends, respectively, of the forming member 16. In other words, the top beam 38 and toe 40 portions of the concrete face 12 may each extend inwardly to terminate substantially flush with the inwardly-facing surface 24 of the forming member 16. In other embodiments, the top beam 38 and toe 40 portions of the concrete face 12 may terminate outwardly of the forming member inner surface 24, or in other words, may terminate short of the inwardly-facing surface 24 of the forming member 16. In certain of these embodiments, the forming member 16 terminates at an upper edge of the top beam 38 and at a lower edge of the toe 40. In other embodiments, at least one additional forming member (not shown) may be provided along an inner surface of the top beam 38 and/or the toe 40 in order to provide moisture resistance, vapor permeability, and/or to decreased overall thermal conductivity of these portions of the wall structure 10.

In several embodiments, the forming member 16 defines a relatively smooth inwardly-facing surface 24 opposite the outwardly-extending protrusions 20. In some embodiments, the inwardly-facing surface 24 of the forming member 16 defines an interior surface of the wall structure 10. In other embodiments, one or more additional layers, such as for example insulating layers, waterproofing layers, etc., may be added along the inwardly-facing surface 24 of the forming member 16 to establish a finished inner-most surface of the wall structure 10. For example, in one embodiment, an additional layer of fiber cement board is provided along the inwardly-facing surface 24 of the forming member 16, thereby forming an inner-most surface of the wall structure 10.

Figure 4:
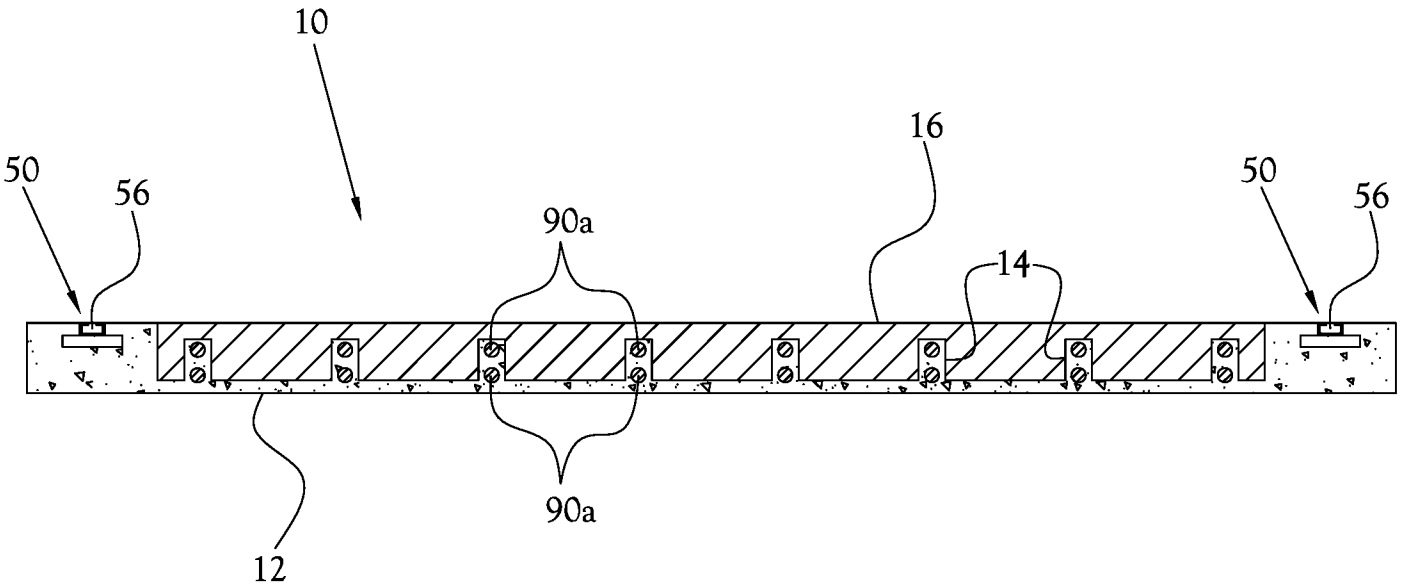
FIG. 4 is cross-sectional top view of the precast concrete composite wall of FIG. 1.
Figure 5:
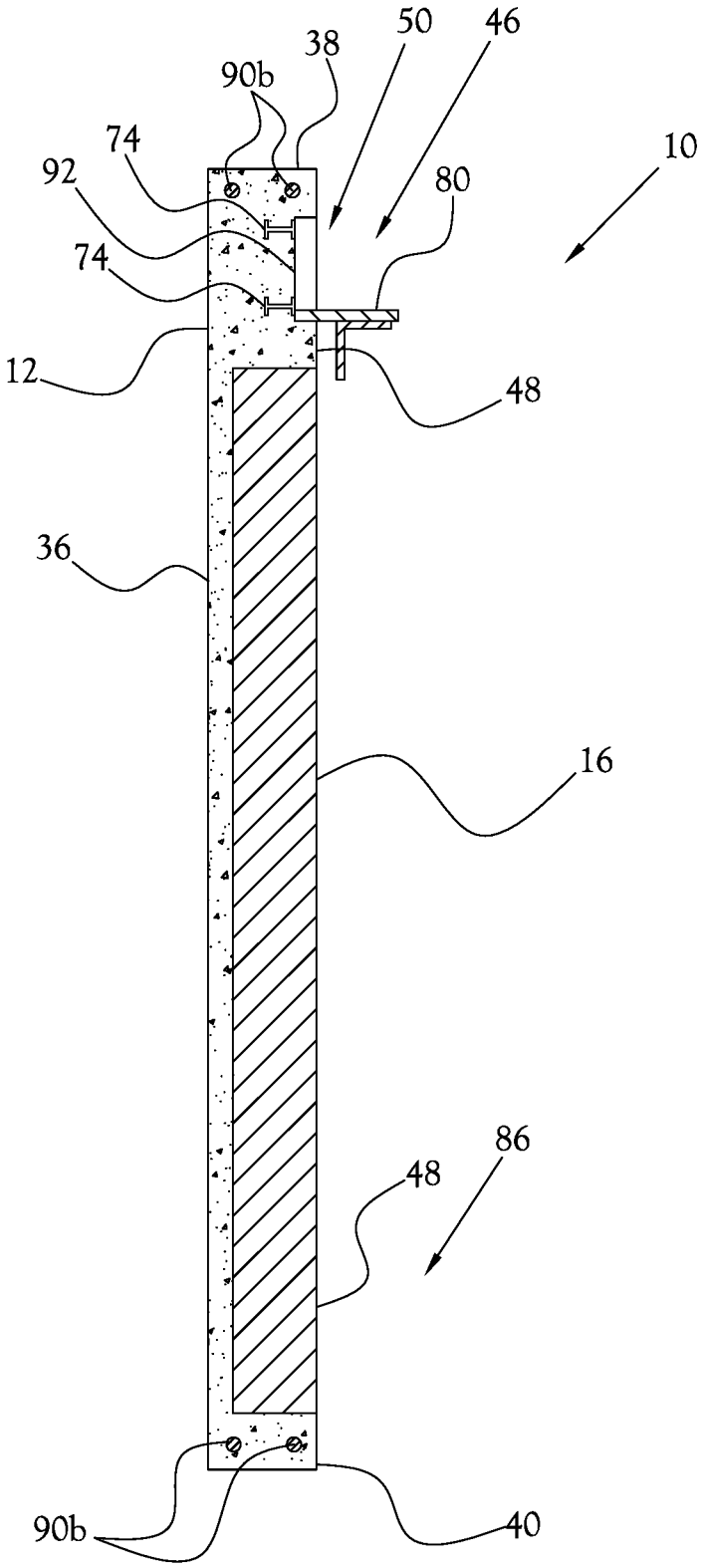
FIG. 5 is cross-sectional side view of the precast concrete composite wall of FIG. 1.
Figure 6:
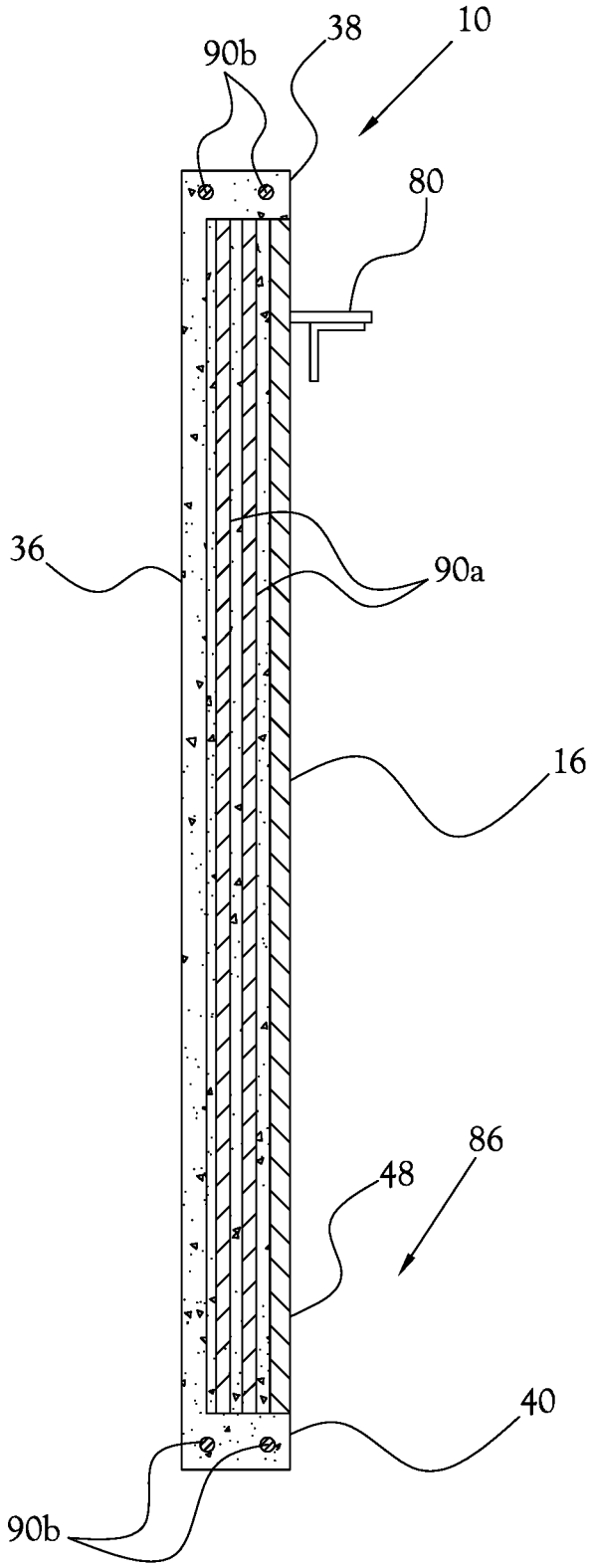
FIG. 6 is another cross-sectional side view of the precast concrete wall of FIG. 1, showing an internal view of one of the ribs.

With reference to FIGS. 4-6, in several embodiments, the concrete face 12 is fabricated from a reinforced concrete material, of the type having a plurality of reinforcing members embedded in a cement-based concrete material. For example, in the present embodiment, a plurality of elongated steel reinforcing members 90 are provided within the concrete face 12, extending substantially parallel to the inner and outer surfaces 18, 36 thereof. More specifically, in the present embodiment, a plurality of first elongated steel members **90*a* are provided, with each first steel member 90*a* extending within and along a respective rib 14 of the concrete face 12. In the illustrated embodiment, a plurality of second elongated steel members 90*b* are provided, with each second steel member 90*b* extending within and along a respective one of the top beam 38 and toe 40 portions of the concrete face 12. The various steel members 90 cooperate to strengthen the concrete face 12 and resist flexure and/or failure of the concrete face 12 upon subjection of the wall structure 10 to loads. In certain embodiments, additional reinforcement, for example in the form of additional reinforcing steel members disposed elsewhere in the concrete face 12 or in the form of wire mesh or fiber materials distributed throughout the concrete face 12**, may be provided.

It will be recognized that the above-discussed reinforcement against flexure of the concrete face 12 may be useful in various applications of the wall structure 10, such as for example use of the wall structure 10 in forming a knee wall, sleeper wall, cladding wall, or other wall structure of a building, or in forming a basement wall or retaining wall structure. However, it will further be understood that the reinforcing members may be provided at other locations within the concrete face 12 without departing from the spirit and scope of the present general inventive concept. For example, in other embodiments, one or more reinforcing members may be provided slightly interior to the outer surface 36 of the concrete face 12 to reinforce the concrete face against flexure.

As will be discussed in further detail hereinbelow, and with reference now to FIGS. 1 and 5-9, in various embodiments, one or more upper restraint fasteners 46 are provided at opposite upper corners of the concrete face 12 along the inner surface of the wall structure 10, with each upper restraint fastener 46 being disposed slightly below the top beam 38 and slightly inward of one of opposite first and second sides 52, 54 of the concrete face 12, in order to assist in securing the wall structure 10 adjacent a support structure, such as for example an I-beam column or other structure. More specifically, in the illustrated embodiment, a pair of concrete blocks 48 are provided, with each concrete block 48 being integrally formed with the inwardly-facing surface 18 of the concrete face 12 and with the top beam 38. Each concrete block 48 is further integrally formed with a respective one of the first and second sides 52, 54 of the concrete face 12. In the illustrated embodiment, each concrete block 48 extends inwardly from the inwardly-facing surface 18 of the concrete face 12 to terminate substantially flush with the inward-most surface of the wall structure 10. Accordingly, in the illustrated embodiment, each respective upper corner of the forming member 16 defines a cutout 100 which is sized and shaped to receive a respective one of the concrete blocks 48 therein. Stated differently, the portions of the perimeter of the forming member 16 defining the cutouts 100 terminate along the perimeter of a respective concrete block 48, such that, in the illustrated embodiment, the inward-most surfaces of the concrete blocks 48 cooperate in defining the innermost surface of the wall structure 10.

Each upper restraint fastener 46 is secured to a respective one of the concrete blocks 48 and at least partially extends therefrom to form a fastener for securing the wall structure 10 to a support structure. More specifically, and with reference to FIGS. 5 and 7-9, in the illustrated embodiment, each upper restraint fastener comprises an anchor 50 and a tab fastener 80. Each anchor 50 is embedded in a corresponding concrete block 48 and defines a hollow channel 56 which extends along, and opens to, an interior surface of the concrete block 48. More specifically, in the present embodiment, each anchor 50 is defined by an elongated length of hollow steel channel 92 having a substantially rectangular cross-sectional shape. The steel channel defines a slot 94 extending along the length of one of the walls of the channel. Thus, the slot 94 provides access to the hollow interior of the steel channel 92 along the length thereof, while the remainder of the wall on which the slot is defined forms a pair of oppositely-disposed lips 58 extending partially over the channel interior 56, along opposite lengths of the channel.

In various embodiments, suitable structures exist within the wall structure 10 to close the opposite ends 96, 98 of the channel 92, such that access to the hollow interior of the channel is available only through the slot. For example, in the depiction of the anchor 50 shown in FIG. 7, the ends 96, 98 of the steel channel 92 are, themselves, open. However, as shown in FIG. 5, in the present embodiment, the steel channel 92 is embedded in the block portion 48 of the concrete face 12. Thus, in this embodiment, the portions of the concrete face 12 surrounding the steel channel 92 serve to close the ends 96, 98 and to restrict access to the hollow interior except through the slot 94. In other embodiments, the steel channel 92 includes walls disposed at each end 96, 98 thereof to close the ends.

As stated above, in the illustrated embodiment, each channel 92 of each upper restraint fastener 46 is embedded in a corresponding concrete block 48 defined by the concrete face 12, with the slot 94 opening to the interior surface of the wall structure 10. In various embodiments, each anchor 50 of each upper restraint fastener 46 may include one or more additional members to assist in securing the channel 92 within the concrete block 48. For example, in the illustrated embodiment, each anchor portion 50 of each upper restraint fastener 46 further includes a pair of short I-beam segments 74 which are secured to an outer surface of the channel, as by welds or other means known to one of skill in the art. The I-beam segments 74 assist in engaging the concrete forming the concrete block 48 and surrounding the anchor 50. Thus, the I-beam segments 74 assist in securing the channel 92 within the concrete block 48.

Figure 7:
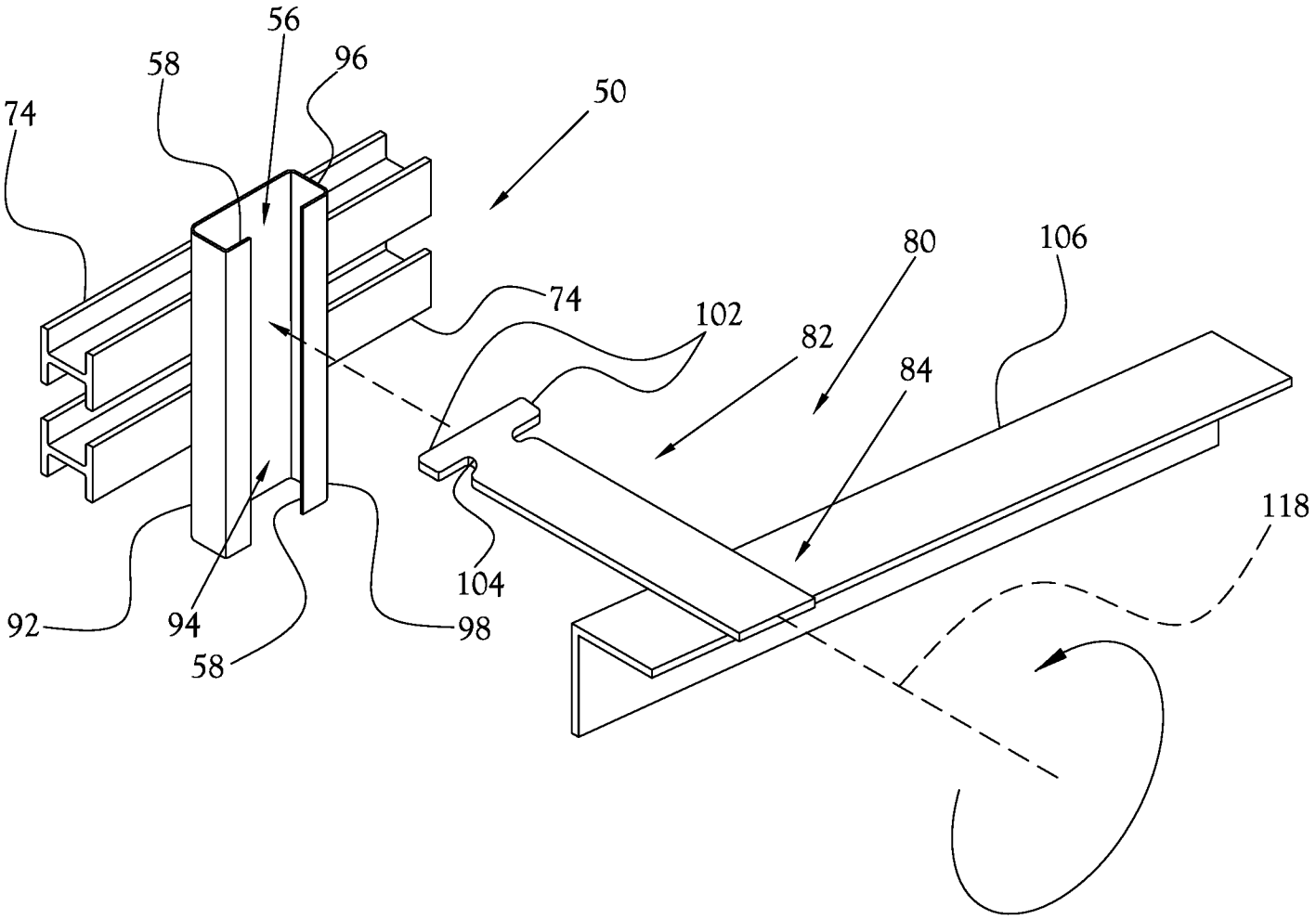
FIG. 7 is a perspective view showing portions of the upper restraint fastener of the precast concrete composite wall of FIG. 1.

In the illustrated embodiment, for each anchor 50 described above, a tab fastener 80 is provided. Referring to FIG. 7, the tab fastener includes a first end 82 defining a relatively flat, tab shape. More specifically, the first end 82 of the tab fastener 80 defines a pair of tabs 102 extending outwardly from a longitudinal centerline 118 of the tab fastener 80, and a tapered portion 104 inward of the tabs 102. The tabs 102 and tapered portion 104 cooperate to define a shape such that, when the flat portion of the tab fastener first end 82 is oriented to extend along a plane perpendicular to the long dimension of the anchor channel 56, the tapered portion 104 fits within the slot 94 of the channel, between the lips 58, and the tabs 102 extend within the channel 56 and beyond the lips 58, thus limiting separation of the tab fastener first end 82 from the anchor 50 in this orientation. In a preferred embodiment, the tabs 102 and tapered portion 104 cooperate to define a shape which is keyed to, and thus conforms closely with, the cross-sectional shape of the channel 56. Thus, when the tabs 102 are received within the channel 56 in the above-described orientation with the tapered portion 104 fitted within the slot 94 of the channel, between the lips 58, and the tabs 102 extending within the channel 56 and beyond the lips 58, a snug fit is established between the tabs 102 of the tab fastener first end 82 and the channel 56. However, it will be recognized that such a keyed, snug fit between the tab fastener first end 82 and the channel 56 is not crucial to accomplishing an embodiment of the present general inventive concept.

Figure 9:
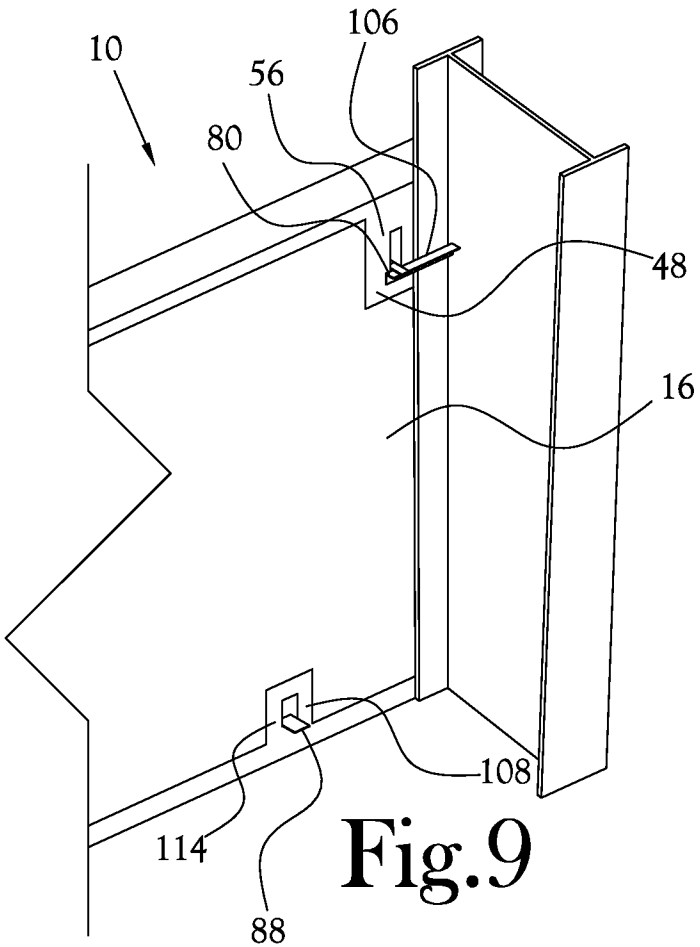
FIG. 9 is a partial perspective view of the precast concrete wall of FIG. 1, showing the upper restraint fastener in a second configuration.
Figure 8:
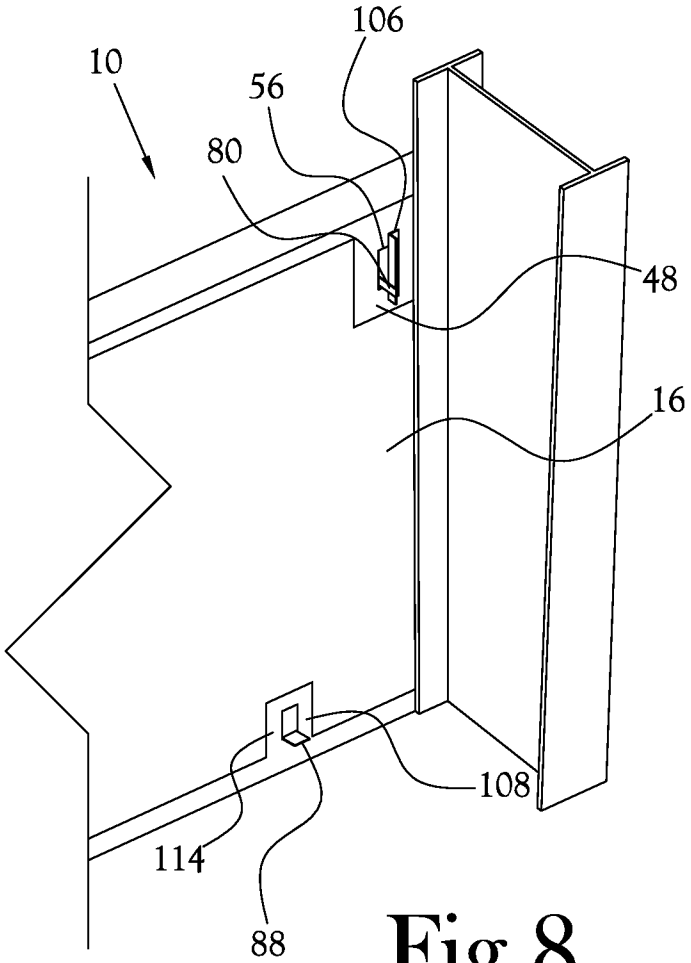
FIG. 8 partial perspective view of the precast concrete wall of FIG. 1, showing the upper restraint fastener in a first configuration.

Referring to FIGS. 7-9, the thickness of the flat portion of the tab fastener first end 82 is such that, in a first orientation (see FIG. 8), in which the flat portion of the first end 82 extends along a plane substantially parallel with the long dimension of the slot 94, the tabs 102 of the first end 82 may be received into the slot 56. Thereafter, the tab fastener 80 may be rotated to a second orientation (see FIG. 9), in which the pair of lips 58 of the slot 94 engage the tabs 102 and limit removal of the first end 82 from the slot 56.

A second end 84 of the tab fastener 80 extends generally inwardly from the slot 56 and may, in various embodiments, be secured to one or more additional members, such that the tab fastener 80 may be used to assist in fastening the wall structure 10 to a support structure. For example, in the illustrated embodiment, the second end 84 of the tab fastener 80 is secured to a segment of angle iron 106, as by weld, adhesive, or other means of the type known in the art. The angle iron 106 extends at a substantially right angle to the long dimension of the tab fastener 80, and the angle iron 106 is of a relative length that, when the tab fastener 80 is oriented in the first orientation within the slot 56, the angle iron 106 extends substantially vertically and is disposed away from the side edges of the concrete face 12. However, when the tab fastener 80 is then moved to the second orientation, the angle iron 106 rotates to extend substantially horizontally toward a corresponding side edge of the concrete face 12. Thus, as illustrated in FIGS. 8 and 9, when the tab fastener 80 is either removed entirely from the anchor 50 or oriented in the first orientation within the slot 56, the wall structure 10 may be positioned along a support structure, such as against the illustrated vertical I-beams, with each opposite respective side edge 52, 54 of the concrete face 12 adjacent a corresponding flange of one of the vertical I-beams. Thereafter, when the tab fastener 80 is inserted into the channel 56 and oriented in the second orientation therein, the angle iron 106 rotates to extend substantially horizontally, inward of the flange of the corresponding I-beam. In this configuration, the flange of the vertical I-beam is engaged between the angle iron 106 and the wall structure side edge 52, 54, thereby securing the wall structure 10 adjacent the I-beam.

Figure 10:
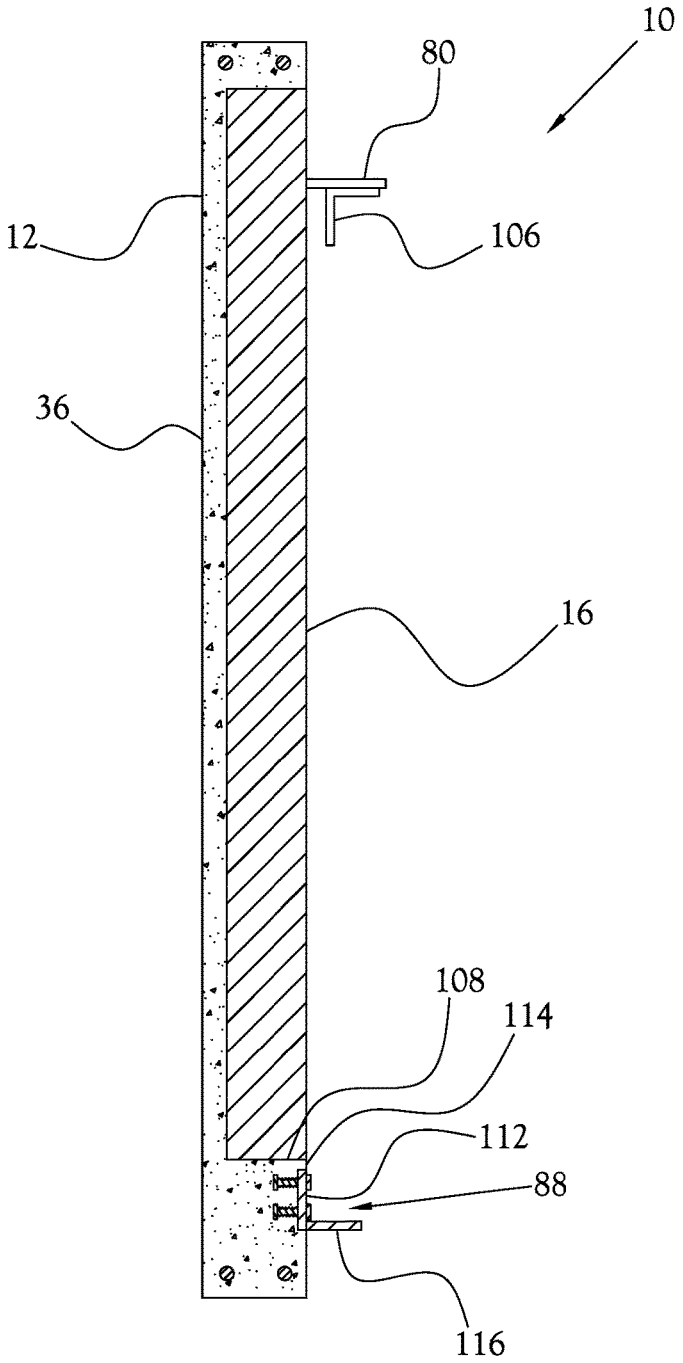
FIG. 10 is a cross-sectional side view of the precast concrete wall of FIG. 1, showing an internal view of the lower restraint fastener.

In various embodiments, one or more lower restraint fasteners 86 are also provided at locations along the lower toe portion 40 of the wall structure 10. Referring now to FIGS. 1 and 10, in the illustrated embodiment, similarly to the upper restraint fasteners described above, for each lower restraint fastener 86, a concrete block 108 is provided which is integrally formed with the inner surface 18 and the lower toe portion 40 of the concrete face 12. Each concrete block 108 extends inwardly from the concrete face inner surface 18 to terminate substantially flush with the inward-most surface of the wall structure 10. Thus, similarly to the concrete blocks 48 associated with the upper restraint fasteners described above, for each concrete block 108 of the lower restraint fasteners 86, the forming member 16 defines a cutout 110 which is sized and shaped to receive a respective one of the concrete blocks 108 therein.

In the illustrated embodiment, each concrete block 108 associated with the lower restraint fasteners 86 has affixed thereto an L-bracket 88 having a first flange 112 embedded within and extending along an inwardly-facing surface 114 of the concrete block 108 and a second flange 116 extending at an approximate right angle thereto. Each second flange 116 extends substantially horizontally inwardly at an elevation along the inner surface of the wall structure 10 as to allow the second flange 116 to be secured against a floor surface, against which the wall structure 10 is placed. In various embodiments, in addition, or in the alternative, to being embedded in a corresponding concrete block 108, the first flange 112 of each L-bracket 88 is secured to a respective concrete block 48 by one or more bolts, screws, or other such fasteners embedded within the concrete block 48. However, those of skill in the art will recognize other means for securing the L-bracket to the concrete block which may be used without departing from the spirit and scope of the present general inventive concept.

It will be recognized that numerous other fastening devices and configurations therefor are contemplated for use in accomplishing the upper and lower restraint fasteners 46, 86, and such other devices and configurations may be used pursuant to the present general inventive concept. For example, the above-described fastener system incorporating the embedded slot 56 and tab fastener 80 may be used to accomplish either, or both, of the upper and lower restraint fasteners. Likewise, the above-described fastener incorporating the L-bracket 88 may be used to accomplish either, or both, of the upper and lower restraint fasteners. Additional or alternate fastening devices which may be incorporated into the above-described upper and lower restraint fasteners 46, 86 will be recognized by one of skill in the art, and such devices may be used without departing from the spirit and scope of the present general inventive concept.

Figure 11:
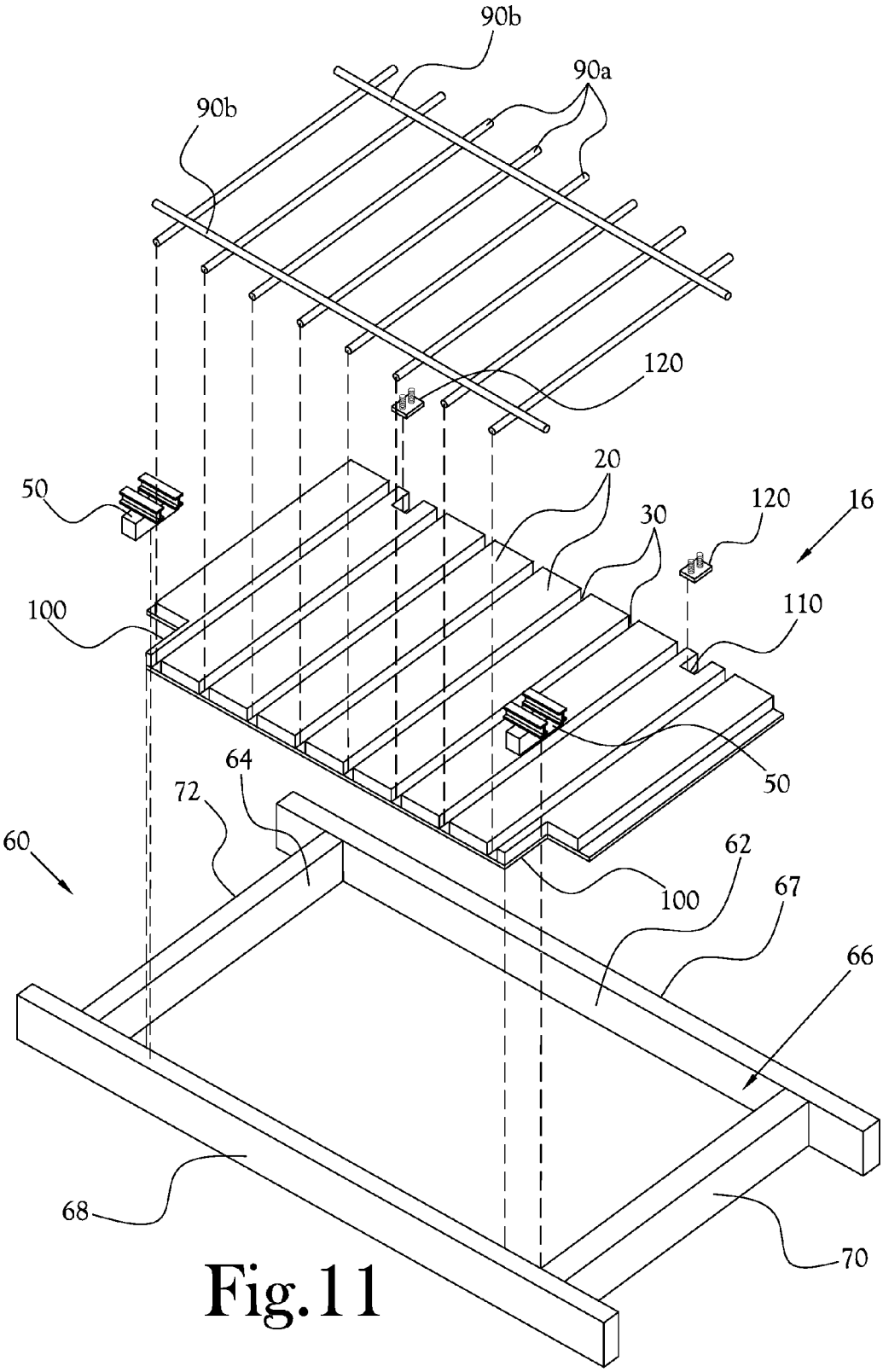
FIG. 11 is a partially exploded perspective view showing various operations of one embodiment of a method according to several features of the present general inventive concept.
Figure 12:
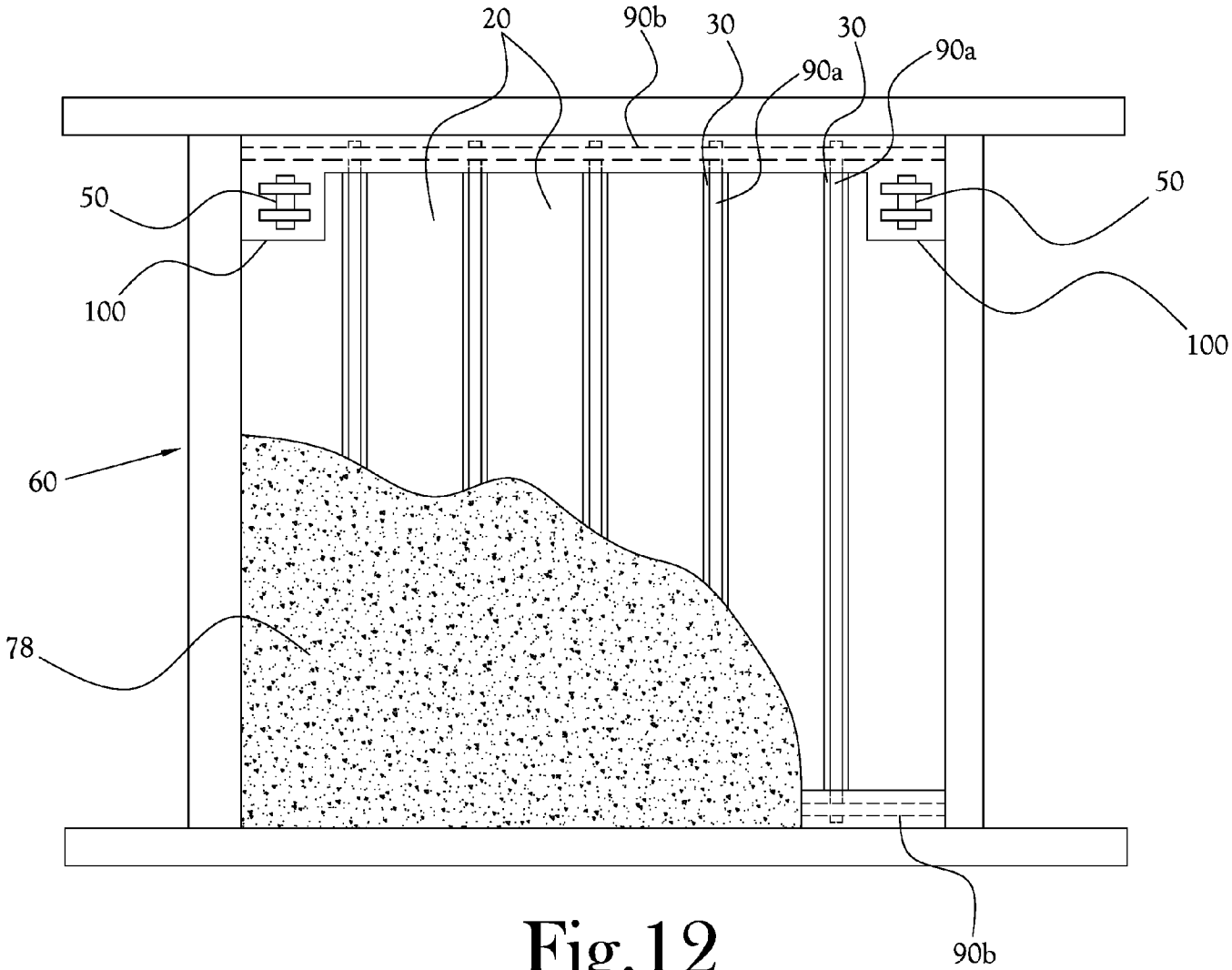
FIG. 12; a top view showing other operations of the method of FIG. 11.

In accordance with several additional features of the present general inventive concept, a method of manufacturing a precast concrete wall structure is also disclosed herein and in the accompanying figures. Various operations according to one embodiment of a method of manufacturing a precast concrete wall structure, or "method," may be understood by reference to the illustrations depicted in FIGS. 11-12 and the description herein. With reference to FIGS. 11-12, in one embodiment, a casting bed 60 is provided having a plurality of surfaces 62, 64 for defining a generally rectangular interior area 66 corresponding generally to a desired overall shape of the finished wall structure 10. In the embodiment of FIG. 11, the casting bed 60 includes generally first and second elongated side rails 67, 68 arranged in a parallel, spaced-apart relationship, with first and second elongated gate members 70, 72 extending therebetween in parallel, spaced-apart relationship with one another, and in perpendicular relationship with the first and second side rails 67, 68. Each side rail 67, 68 defines an interior planar surface 62 facing an interior planar surface 62 of the opposite side rail 67, 68, and likewise, each gate member 70, 72 defines an interior planar surface 64 facing an interior planar surface 64 of the opposite gate member. Thus, the planar surfaces 62, 64 cooperate to define a substantially rectangular interior area 66 therebetween. The various side rails 67, 68 and gate members 70, 72 may be assembled and placed along a substantially flat, level support surface, such as a table or the floor, with respective lower edges of the interior planar surfaces 62, 64 substantially flush with the support surface, thereby substantially closing the lower end of the rectangular interior area 66. Thus, the interior area 66 forms a substantially planar, rectangular mold having an interior shape substantially corresponding to a desired overall shape of the finished wall structure 10.

With reference to FIG. 11, a forming member 16 may be provided and positioned within the casting bed 60 with the rectangular protrusions 20 of the forming member 16 protruding generally upwardly. In several embodiments, the casting bed 60 is sized such that the forming member 16 extends substantially fully between opposite interior surfaces 64 of the of the gate members 70, 72 and/or between opposite interior surfaces 62 of the side rails 67, 68. In other embodiments, the forming member 16 may be sized to extend only partially between opposite interior surfaces 62 of the of the side rails 67, 68 and/or between opposite interior surfaces 64 of the gate members 70, 72. In such embodiments, the forming member 16 may be positioned between the opposite interior surfaces 62, 64 of the side rails 67, 68 and gate members 70, 72 so as to provide space between the forming member 16 and the interior surfaces 62, 64 for formation of the top beam 38 and toe 40 portions of the wall structure 10 discussed above. In some embodiments, a suitable spacer may optionally be positioned between the forming member and at least one interior surface 62, 64 of the casting bed 60 to assist in positioning the forming member at a desired location along the support surface of the casting bed 60. In some embodiments, the spacer may be designed to form a portion of the top beam 38 or toe 40 of the wall structure 10 upon completion of the wall structure 10 as described hereinbelow.

As discussed above, the forming member 16 includes a plurality of rectangular protrusions 20 extending in parallel and spaced-apart relationship to define a plurality of parallel channels 30 extending along a width dimension of the forming member 16. The forming member 16 further defines the above-discussed cutouts 100, 110 defining mold shapes for forming the above-discussed concrete blocks 48, 108. In one embodiment, the forming member 16 is defined by a single, unitary member. In other embodiments, the forming member 16 is defined by a plurality of members arranged in side-by-side relationship to form the forming member 16. For example, in one embodiment, a plurality of forming member segments are provided, with each segment defining a portion of the total length of the forming member 16, including one or more of the rectangular protrusions 20 and one or more channels 30. In this embodiment, a plurality of forming member segments are provided and arranged in side-by-side relationship to form the complete forming member 16, including the desired number of rectangular protrusions 20 and channels 30 interposed therebetween. The forming member segments may be secured to one another via suitable fasteners of the type known to one of skill in the art.

With further reference to FIG. 11, following placement of the forming member 16 in the casting bed 60, a plurality of reinforcing members 90*a*, 90*b* are optionally positioned within the casting bed 60 at locations either above the forming member 16 or between the protrusions 20, within the channels 30. As discussed above, the reinforcing members 90*a*, 90*b* may be of the type commonly used to reinforce concrete, such as for example rebar segments, wire mesh, or the like. The reinforcing members 90*a*, 90*b* may be supported centrally along each of the channels 30 or may be supported from contact with the surfaces of the forming member 16 using suitable spacers of the type known to one of skill in the art. Additionally, for each of the above-discussed cutouts 100 defining a concrete block 48 associated with an upper restraint fastener 46, an anchor 50 is placed within the cutout 100 in the casting bed 60, with the slot 56 of the anchor 50 facing a lower surface of the casting bed 60. In the illustrated embodiment, each anchor 50 is positioned such that the slot 56 extends generally parallel to the channels 30 of the forming member. However, it will be recognized that such orientation is not crucial to accomplishing the present general inventive concept.

In the illustrated embodiment, for each cutout 110 defining a concrete block 108 associated with a lower restraint fastener 86, a spacer 120 is positioned within the cutout 110 in the casting bed 60. The spacer 120 defines a shape and thickness generally corresponding to that of the first flange 112 of the L-bracket 88. In the illustrated embodiment, the above-discussed bolts associated with the lower restraint fastener 86 are secured at spaced apart locations along the spacer 120 and extend generally upwardly therefrom. However, it will be recognized that inclusion of the bolts is optional, and is not crucial to accomplishing the present general inventive concept. In addition to placement of the above-discussed features, any additional features to be embedded within the concrete of the wall structure 10 may likewise be positioned within the casting bed 60.

As shown in FIG. 12, following placement of the forming member 16, reinforcing members 90*a*, 90*b*, anchors 50, spacers 120, and/or other features of the wall structure 10, uncured, flowable concrete 78 is placed within the casting bed 60. The concrete 78 is allowed to fill each of the channels 30 and any voids between the side walls 62, 64 of the casting bed 60 and the forming member 16. In certain embodiments, an upper surface of the uncured concrete 78 is finished to a substantially level surface. In other embodiments, self-leveling concrete is employed, such that finishing the upper surface subsequent to pouring the concrete 78 into the casting bed 60 is not necessary. In still other embodiments, and in particular in certain embodiments in which the outer surface of the concrete face 12 is to be exposed, such as for example when the wall structure 10 is to be used in an above-ground or partially above-ground setting, the uncured concrete 78 may be finished to a desired texture and/or color via tamping, troweling, brushing, stamping, dying, or other techniques known in the art. The concrete is allowed to at least partially cure to form a rigid concrete face 12, thereby forming the finished wall structure 10. The wall structure 10 may then be removed from the casting bed 60 by means known in the art, such as for example by lifting the wall structure 10 and/or by disassembling, or partially disassembling, the casting bed 60. In still other embodiments, following curing of the concrete to form the rigid concrete face 12, the exterior surface of the concrete face 12 is further finished to a desired surface or texture. For example, in one embodiment, following curing of the concrete, an additional application of material, such as for example paint, stain, wood or brick veneer, plaster, or the like, is applied to the outer surface of the concrete face 12. In another embodiment, following curing of the concrete, the outer surface of the concrete face 12 is abraded, such as for example by sanding, sandblasting, or the like, to a desired finish.

From the foregoing description, it will be recognized by one skilled in the art that a precast concrete wall structure and method for manufacturing a precast concrete wall structure are provided herein which allow significant improvement over prior art methods and apparatus. For example, it will be recognized that, by forming the forming layer 16 from an insulating material, such as for example expanded polystyrene (EPS), extruded polystyrene (XPS), rockwool, or other such material, the forming layer 16 serves to increase the insulating properties of the wall structure 10, thereby allowing the wall structure 10 to be used in applications in which an insulating wall is desired absent the need to add further insulating material to the wall structure 10. It will further be recognized that the amount of thermal resistance provided by the materials of the forming layer 16 are, at least in part, a function of the average thickness per unit area of forming layer material along the surface of the wall structure 10. Accordingly, it will be recognized that the specific dimensions of the forming layer 16, i.e., the thickness, width, and spacing of the protrusions 20 and of the portions of the forming layer 16 between the protrusions 20, may vary in order to achieve a desired thermal resistance of the wall structure 10, while also maintaining structural integrity of the wall structure 10 and suitability of the wall structure 10 for use in a specific application. It will further be recognized that the specific dimensions of the forming layer 16 may also be adjusted to achieve a desired structural integrity, and/or to satisfy desired structural requirements of the wall structure 10.

It will be recognized that, through application of the method disclosed herein, a precast concrete wall structure may be made having significant advantages over conventional poured-in-place concrete wall structures. Through application of the method disclosed herein, a precast concrete wall structure weighing approximately 50 lbs. per square foot may be produced, wherein a poured-in-place concrete structure of the same thickness would weigh approximately 126 lbs. per square foot. Thus, significant reductions in material cost and associated transportation expense may be achieved. Furthermore, it will be recognized that the precast concrete wall structure provided herein includes a frame having studs pre-installed along one surface thereof, thereby saving the expense and labor associated with installing these fixtures at the desired finished location for the wall structure. In several embodiments, the EPS and XPS materials forming the wall structure may be recycled into other products following their use in the wall structure, and in certain embodiments, scrap EPS materials may be used to form the forming member. Furthermore, it will be understood that the reinforcing members may be formed from recycled materials, i.e., recycled rebar, without departing from the spirit and scope of the present general inventive concept.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein. Numerous variations, modification, and additional embodiments are possible, and, accordingly, all such variations, modifications, and embodiments are to be regarded as being within the spirit and scope of the present general inventive concept. Furthermore, while the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. A precast concrete wall structure comprising:

an insulating layer comprising a layer of insulating material having a substantially flat first surface and an opposite second surface defining a plurality of integrally-formed rectangular protrusions extending along a length dimension of the insulating layer in a parallel and spaced-apart relationship to one another to define a plurality of rectangular-shaped channels therebetween;

a concrete face in mating relationship with the second surface of the insulating layer, the concrete face comprising a layer of concrete material having a first surface disposed adjacent the second surface of the insulating layer, the first surface of the layer of concrete material defining a plurality of rectangular-shaped ribs, each rib being keyed to and disposed within a respective channel of the layer of insulating material;

at least one first fastener disposed along a plane coplanar with the insulating layer first surface and configured to secure the wall structure adjacent to a support structure, the at least one first fastener comprising a first member defining a slot and a second member defining a tabbed portion configured to be selectively received by and removed from the slot when disposed in a first orientation, and configured to engage the first member to limit withdrawal of the tabbed portion from the slot when rotated to a second orientation; and at least one second fastener disposed along a plane coplanar with the insulating layer first surface, the second fastener being configured to secure the wall structure adjacent a floor structure, wherein for each second fastener, the concrete face further defines a second concrete block integrally formed with the layer of concrete material, the second concrete block having a first surface extending coplanar with the insulating layer first surface, the second fastener being secured to the second concrete block, wherein the second fastener defines an L-bracket having a first flange extending along the second concrete block first surface and a second flange extending outwardly from the second concrete block first surface at an approximate right angle thereto, and wherein the first flange of the L-bracket is embedded in the second concrete block.

2. The precast concrete wall structure of claim 1, the first member comprising a hollow channel embedded within the wall structure, the channel defining the slot along a length thereof, the slot opening to a surface of the wall structure coplanar with the insulating layer first surface, the channel member further defining a pair of lips extending along opposite sides of the slot and overhanging an interior of the channel member.

3. The precast concrete wall structure of claim 2, the first member further comprising at least one anchor member secured to a surface of the channel member opposite the slot, wherein at least the anchor member of the first member is embedded in the concrete face.

4. The precast concrete wall structure of claim 3, wherein for each first fastener, the concrete face further defines a first concrete block integrally formed with the layer of concrete material, the first concrete block having a first surface extending coplanar with the insulating layer first surface, the first member being embedded in the first concrete block.

5. The precast concrete wall structure of claim 4, the second member defining an elongated first portion having a first end defining the tabbed portion and an elongated second portion extending at a substantially right angle to the first portion.

6. The precast concrete wall structure of claim 5, the first portion first end defining a flat portion having a pair of tabs extending outwardly from a longitudinal centerline of the first portion and a tapered portion inward of the tabs, whereby in a first orientation of the second member in relation to the first member, in which the tabs extend parallel to the slot, the tabs may be received through the slot within the channel with the tapered portion positioned between the lips of the first member, and whereby in a second orientation of the second member in relation to the first member, in which the tabs extend along a plane perpendicular to the slot, the tabs are engaged by the lips, thereby limiting withdrawal of the tab from the slot.

7. The precast concrete wall structure of claim 6, the second portion of the first fastener second member being defined by a length of structural steel.

8. The precast concrete wall structure of claim 7, wherein the structural steel is angle iron.

* * * * *